US008668152B2

(12) United States Patent
Bösterling et al.

(10) Patent No.: US 8,668,152 B2
(45) Date of Patent: Mar. 11, 2014

(54) ANGLE GUIDE PLATE AND SYSTEM FOR SECURING A RAIL

(75) Inventors: Winfried Bösterling, Neuenrade (DE); Lutz Rademacher, Lüdenscheid (DE)

(73) Assignee: Vossloh-Werke GmbH, Werdohl (DE)

( * ) Notice: Subject to any disclaimer, the term of this patent is extended or adjusted under 35 U.S.C. 154(b) by 171 days.

(21) Appl. No.: 12/996,902

(22) PCT Filed: Jun. 23, 2009

(86) PCT No.: PCT/EP2009/057804
§ 371 (c)(1),
(2), (4) Date: Feb. 23, 2011

(87) PCT Pub. No.: WO2010/003817
PCT Pub. Date: Jan. 14, 2010

(65) Prior Publication Data

US 2011/0138734 A1 Jun. 16, 2011

(30) Foreign Application Priority Data

Jul. 9, 2008 (DE) ..... 10 2008 032 353

(51) Int. Cl.
*E01B 9/00* (2006.01)
*E01B 13/00* (2006.01)

(52) U.S. Cl.
USPC ..... 238/315; 238/351

(58) Field of Classification Search
USPC ..... 238/264, 283, 310, 315, 321, 338, 343, 238/349, 351
See application file for complete search history.

(56) References Cited

U.S. PATENT DOCUMENTS

| | | | | |
|---|---|---|---|---|
| 4,569,478 | A | 2/1986 | Bryan | |
| 4,907,740 | A * | 3/1990 | Oberweiler et al. | 238/283 |
| 6,471,139 | B1 | 10/2002 | Bruder et al. | |

FOREIGN PATENT DOCUMENTS

| | | | |
|---|---|---|---|
| DE | 3111876 | A1 | 6/1982 |
| EP | 0295685 | A1 | 12/1988 |
| EP | 0462436 | A1 | 12/1991 |
| EP | 0733433 | A1 | 9/1996 |
| WO | 9858125 | A1 | 12/1998 |

OTHER PUBLICATIONS

Vossloh Fastening Systems GmbH, "Rail fastening systems for concrete sleepers System W14", Product Brochure.

* cited by examiner

*Primary Examiner* — R. J. McCarry, Jr.
(74) *Attorney, Agent, or Firm* — The Webb Law Firm

(57) ABSTRACT

A rail securing system comprising at least one angle guide plate allows a perfect retention of the tension clamp in its pre-assembly position and facilitates final assembly. The angle guide plate has recess, which is designed as a seat for a free end section of a spring arm of a tension clamp to be mounted on the angle guide plate, wherein the recess engages around the end section by less than half of its circumference. The transition between the recess and the section of the angle guide plate which follows on from the recess in the direction of the rail is formed such as to be free of any abrupt change, so that the tension clamp can be pushed in a simple manner on the angle guide plate into its assembly position.

14 Claims, 4 Drawing Sheets

ANGLE GUIDE PLATE AND SYSTEM FOR SECURING A RAIL

BACKGROUND OF THE INVENTION

1. Field of the Invention

The invention relates to an angle guide plate for the fitting of a rail on a foundation, with a recess serving as a seat for a free end section of a spring arm of a tension clamp to be mounted on the angle guide plate, as long as said tension clamp is located in the pre-assembly position, wherein the recess surrounds the end section by less than half of its circumference.

The invention likewise relates to a system for securing a rail on a foundation, wherein this system comprises an angle guide plate, a W-shaped tension clamp arranged on the angle guide plate, which has at least one spring arm taking effect with its free end section on the rail which is to be secured, and tensioning means for tensioning the tension clamp against the foundation.

2. Description of Related Art

As explained in the brochure published by the Applicant, "Rail securing systems for concrete sleepers—System W 14", angle guide plates and securing systems of the type under consideration here are used in the securing of rails to a solid foundation, which can be formed, for example, by a concrete sleeper or a concrete plate. The rail to be secured in this situation stands directly on the solid foundation by means of an elastic intermediate layer. To the side, the rail is guided by angle guide plates, a pair of which in each case forms a rail channel which is precisely in place with the course of the track.

With the known securing systems of the type referred to heretofore, the forces introduced via the rail are conducted via the angle guide plate directly into the foundation which carries the rails. For this reason, a shoulder is formed on the individual foundation for each of the angle guide plates, the allocated angle guide plate being supported on said shoulder.

A W-shaped tension clamp is usually mounted on the angle guide plate, which in the complete mounted state presses with the free end sections of its spring arms onto the free upper side of the rail foot of the rail which is to be secured. At a curved support section, facing their free end section in each case and supported on the angle guide plate, the spring arms of the tension clamp merge into a middle loop, which is tensioned against the solid foundation by means of a tension screw.

The U-shaped middle loop of the tension clamp engages around the tension screw. In this situation, its limbs are designed in such a way that, with the tension screw already fitted exerting a reduced clamping force, the tension clamp can be pushed out of a pre-fitting position, in which the free end sections of the spring arms of the tension clamp are seated on a rib extending parallel to the rail which is to be mounted and its support sections are seated on a surface facing the individual shoulder of the solid foundation, into the fitting position, in which the spring arms take effect on the rail foot and the support surfaces of the tension clamp are seated in a recess formed for this purpose into the angle guide plate which recess as a rule is groove-shaped.

In order to ensure the secure seating of the tension clamp in the pre-assembly position, a valley-shaped recess is usually formed on the side facing away from the rail which is to be mounted, into the rib facing the free end sections of the spring arms of the tension clamp. Their overall shape is selected in such a way that the free end sections of the pre-fitted tension clamp are seated in them in positive fit. In this situation, the valley-shaped recess passes at an acute angle into the flat upper side of the rib, which as a rule extends parallel to the standing surface of the angle guide plate facing the foundation. In this way it can be ensured that the tension clamp can only be brought out of its pre-assembly position into the final fitting position by overcoming a certain resistance, over the edge between the valley-shaped recess and the upper side of the rib. Such an unintentional displacement must be prevented, since otherwise the risk arises that the tension clamp will already project into the space intended for the rail before the rail is positioned. This would then impede the proper positioning of the rail.

However, the assembly of the known rail securing systems is rendered elaborate due to the fact that the tension screw which holds the tension clamp in its pre-assembly position must be released by a certain amount in order to be able to move the end sections out of the valley-shaped recess of the rib and push the tension clamp out of the pre-assembly position into the final assembly position. This necessity has proved particularly disadvantageous in practice, because rail fastenings of the type referred to heretofore are, as a rule, assembled in large numbers with the aid of automatic assembly devices. The function of these devices is rendered additionally complicated by the release procedure.

SUMMARY OF THE INVENTION

Against this background, the object of the invention was, with rail securing systems of the type explained heretofore and comprising at least one angle guide plate, on the one hand to ensure in a simple manner perfect retention of the tension clamp in its pre-assembly position and, on the other, to facilitate final assembly.

The invention has achieved this object by means of an angle guide plate. Advantageous embodiments of the angle guide plate according to the invention are indicated in the claims.

The object as indicated above has likewise been achieved by a system for the securing of a rail. Advantageous embodiments of the securing system according to the invention are indicated in the claims.

In accordance with the prior art, an angle guide plate for the assembly of a rail on a foundation according to the invention has a recess. With a pre-assembled securing system according to the invention, the free end section sits in this recess, with which the spring arm of the tension clamp allocated to the angle guide plate according to the invention, in the finished mounted state, exerts the spring force onto the rail necessary to hold it down. Likewise, in accordance with the prior art, the recess in this situation is formed in such a way that it surrounds the end section by less than half of its circumference. In this way the end section of the respective spring arm in the pre-mounted position can indeed sit in the recess in positive fit. The shaping of the recess in this situation, however, allows the end section to be pushed out of the recess, without material of the angle guide plate needing to be displaced.

By, according to the invention, the transition between the recess and at least the section of the angle guide plate following it in the direction of the rail to be mounted now being formed to be free of any abrupt change, shaping of the angle guide plate can be achieved by which, on the one hand, it is guaranteed that the tension clamp is securely held in its pre-assembly position. On the other hand, the design of the angle guide plate according to the invention allows the tension clamp to be pushed out of this position into the final assembly position, without it being necessary for this purpose to release the tensioning means, which in the pre-assembly position are already exerting the retaining force onto the tension clamp necessary to hold the tension clamp reliably in its pre-assembly position. It has therefore transpired that it is possible, with an adequately gentle or flattened transition, for the tension clamp to be pushed out of the recess making use of its own spring resilience, although at the same time relatively high retaining forces are being exerted simultaneously by the tensioning means. At the same it has transpired that these retaining forces can, without any problem, be so high that the tension clamp is held in the pre-assembly position predetermined by the recess of the angle guide plate with an adequately high degree of reliability required in practice.

With the invention it is therefore possible, in a conceivably simple manner, for an angle guide plate, and with it a rail securing system, to be designed in such a way that on the one hand the tension clamp will not of its own accord move out of its pre-assembly position, while on the other hand an operational procedure will be saved, namely the release of the tensioning means before the pushing of the tension clamp into the final assembly position.

In the situation in which an angle guide plate according to the invention has, in accordance with the prior art, a rib extending along a contact surface, in the finished assembled state in contact with the rail which is to be secured, it is likewise possible, as with the prior art, for the recess to be formed in the rib with an angle guide plate according to the invention. In this situation, in order to facilitate still further the movement of the tension clamp out of the pre-assembly position into the final assembly position, and nevertheless still guarantee reliable retention in the pre-assembly position, it is possible according to the invention for a ramp to be formed on the side of the rib facing away from the contact surface, starting from the surface of the main section of the angle guide plate carrying the rib and rising obliquely to the upper side of the rib, into which the mounting space is formed. With this arrangement of the mounting space, on movement from the pre-assembly position into the final assembly position the spring arms of the tension clamp must be subjected to a certain amount of additional tension, as a result of which the reliability with which the tension clamp sits in its pre-assembly position is further increased. The amount by which the spring arms are additionally tensioned is in this case dependent on the difference in height between the recess and the cup of the rib over which the end section of the spring arm must be pushed. Due to the fact that the transition between the mounting space and the section of the angle guide plate, over which the end section of the spring arm slides during the displacement out of the pre-assembly position into the final assembly position, is designed according to the invention to be free of any abrupt change, it is ensured in this situation that the required deformation of the spring arm is adjusted automatically if the tension clamp is pushed in a straight-line movement in the direction of the rail. It is not necessary in this situation for the clamping means to be released from the pre-assembly position.

The transition according to the invention from the mounting space into the adjacent section of the angle guide plate can be put into effect, for example, by the transition between the mounting space and the sections of the ramp adjacent to it being rounded. The rounded shape has the advantage that the mounting space can be formed as a depression with a defined peripheral zone, which must be crossed by the individual end section and therefore represents an effective obstacle against spontaneous movement of the tension clamp out of its pre-assembly position.

A further possibility with the design of an angle guide plate according to the invention lies in the fact that, in the case in which the angle guide plate is provided with a rib, the mounting space is adjacent to the cup, wherein the transition from the mounting space to the rib cup is to be formed free of any abrupt change, in the sense of the invention. For this purpose, the cup can itself have a rounded cross-section shape. This design has the advantage that the tension clamp, with the end section of its spring arm, can then still slide free of any abrupt movement on the rib if the end section has overshot the cup of the rib on its way into the final assembly position.

The transition from the end section of the spring arm onto the rail foot of the rail which is to be secured can be facilitated in that, in an inherently known manner, a sliding surface for the end section of the tension clamp is formed on the front side of the rib facing the rail which is to be fitted, leading obliquely from the cup of the rib as far as the contact surface which is in contact with the rail.

In order to avoid the risk of excessive wear occurring during the assembly of the tension clamp or in ongoing use in the area of the surface sections in which the tension clamp comes in contact with the angle guide plate, the angle guide plate can have a wear-resistant material in at least one of the surface sections concerned. This is expedient in particular at such points at which, during the pushing of the tension clamp which occurs in the course of assembly or in ongoing operation, relative movements occur between the angle guide plate and the tension clamp due to the spring movements carried out by the tension clamp. This can be achieved particularly economically in that the wear-resistant material is applied onto the individual surface section. The wear-resistant material can also be employed, however, in the form of inserts in appropriately prepared mounting spaces in the angle guide plate. It is likewise conceivable for the whole section of the angle guide plate facing the individual surface section to be manufactured from such a wear-resistant material.

The advantages of the invention have a particularly favourable effect in the securing of rails to a foundation which is formed by a concrete sleeper or a concrete plate. This is the case in particular if a shoulder is formed on the foundation, the angle guide plate being supported on said shoulder.

In order to safeguard the spring element pre-mounted on the angle guide plate according to the invention against twisting already during pre-assembly, a contact surface can be formed on the angle guide plate which supports the respective free end section of the spring element. The contact surface can be aligned in this situation in such a way that, together with a surface section allocated to it of a ramp formed on the angle guide plate, it delimits the mounting space in which the end section concerned sits in the pre-assembly position. For this purpose, the contact surface can be formed at an elevation protruding in a hump shape and formed on the upper side of the angle guide plate.

BRIEF DESCRIPTION OF THE DRAWINGS

The invention is described in greater detail hereinafter on the basis of drawings representing an embodiment. These show, diagrammatically.

DETAILED DESCRIPTION OF THE INVENTION

Figure 1:
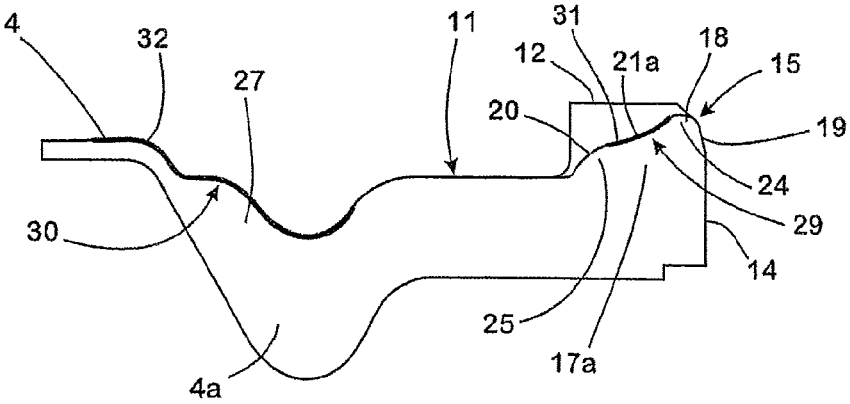
FIG. 1 An angle guide plate in a side view.
Figure 2:
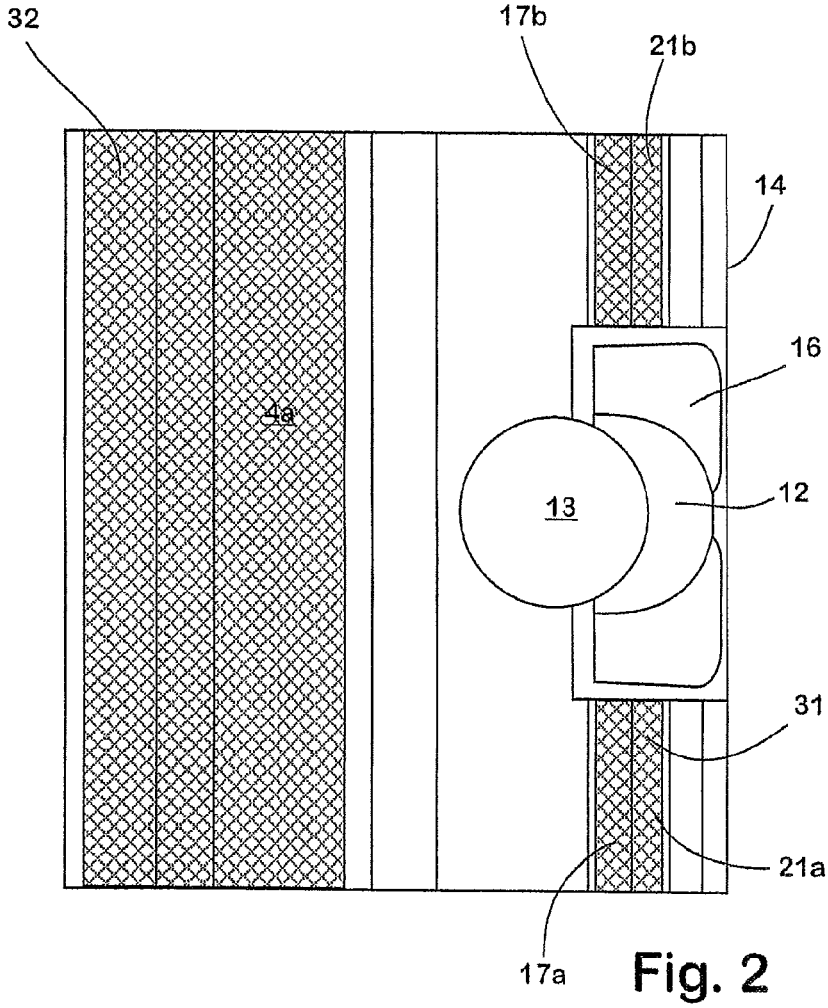
FIG. 2 The angle guide plate according to FIG. 1 in a view from above.
Figure 3:
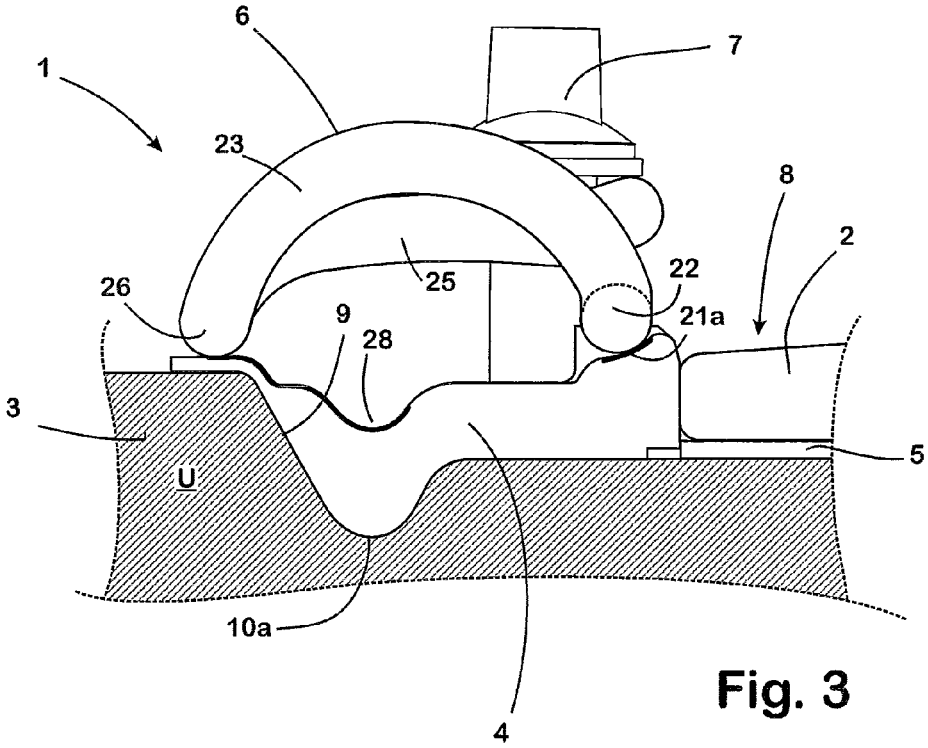
FIG. 3 A system for securing a rail in the pre-assembly position, in a side view.
Figure 4:
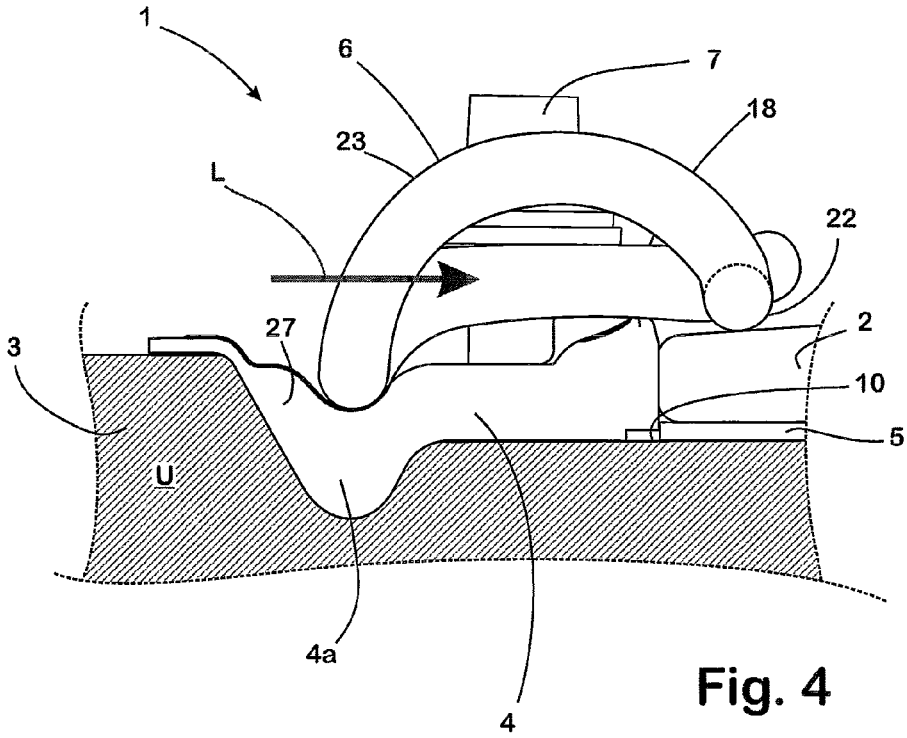
FIG. 4 The system according to FIG. 3 in the final assembly position, in a side view.

The system 1 shown in FIGS. 3 and 4 is used to secure a rail on a fixed foundation U, which in the present example, for the sake of easy overview, is formed from a concrete Sleeper 3 depicted only incompletely. For the same reason, with regard to the rail to be secured, only the edge area of the rail foot 2 facing the system 1 is represented in FIGS. 3 and 4.

The system 1 comprises an angle guide plate 4, an elastic layer 5, a W-shaped tension clamp 6, provided in order to produce the retaining force required, and a tension screw 7 serving as tensioning means for tensioning the tension clamp 6.

The elastic layer 5 consists of a fine-porous highly elastic polyurethane foam, the elasticity of which is provided in such a way that, even if suddenly relieved of pressure after an extended period of full compression, it will immediately relax automatically and expand again up to the initial thickness of the elastic layer 5.

A recess 8 is formed into the concrete sleeper 3, which extends over the width of the concrete sleeper 3 and is delimited at its side ends, seen in its longitudinal direction, in each case by a support shoulder 9. The base of the recess 8 forms a support surface 10, on which the elastic layer 5 lies. In the area of the transition from the support surface 10 to the individual support shoulder 9 in each case a groove 10*a* is formed into the support surface 10. The side end area of the support surface 10 adjacent to the groove 9 forms the area on which, in the fitted position, the angle guide plate 4 lies. In the central position a depression is formed into this end area, in which sits a plastic dowel, not represented here, for the tension screw 7.

The angle guide plate 4 has on its upper side 11 shaped elements 12, which guide the tension clamp 6 and ensure a secure transfer of the retaining forces onto the rail foot 2 of the rail which is to be held by the system 1. Starting from its upper side 11, a passage aperture 13 is additionally formed into the angle guide plate 4. During assembly in an already known manner, the tension screw 7 for tensioning the tension clamp 6 is guided through this aperture 13, in order to screw it into the dowel located in the sleeper 3.

On its face side facing the rail foot 2, the angle guide plate 4 has a contact surface 14, with which the angle guide plate 4 is in contact sideways with the rail foot 2.

Formed on the upper side 11 of the angle guide plate 4 is a rib 15, which extends along the edge of the angle guide plate 4 facing the rail foot 2 and is aligned with its side facing the rail foot 2 flush with the contact surface 14. Formed in the middle table-shaped section 16 of the rib 15 is the individual shaped element 12, which guides the tension clamp 6 in its finished assembled position.

The two sections 17*a*, 17*b* of the rib 15 adjacent to the middle section, by contrast, in each case have a narrow cup 18, rounded in cross-section, which merges on the side of the rib 15 facing the rail foot 2, in an oblique angled sliding surface 19, into the contact surface 14.

On its side facing away from the rail foot 2, the side sections 17*a*, 17*b* are by contrast formed in the manner of a ramp 20 and run from the upper side 11 of the angle guide plate 4, rising obliquely as far as the respective cup 18.

Formed into the ramp 20 is in each case a trough-shaped mounting space 21*a*, 21*b*, extending over the individual section 17*a*, 17*b*. Its shape is adjusted to the outer diameter of the free end sections 22 of the spring arms 23 of the tension clamp 6 in such a way that the end sections 22 can lie in positive fit in the individual mounting spaces 21*a*, 21*b* and the mounting spaces 21*a*, 21*b* are in this situation in each case only in contact around about 30° of their circumference.

The mounting spaces 21*a*, 21*b* merge in each case in gently rounded form into the sections 24, 25 of the ramp 20 which surround them.

In this way, a transition free of abrupt changes is created from the mounting spaces 21*a*, 21*b*, in particular to the section 24, which leads from the mounting space 21*a*, 21*b* as far as the cup 18 of the rib 15, into which it then likewise merges without any abrupt change. The upper side of the ramp 15 facing the tension clamp 6 accordingly has a course which overall does not have any abrupt changes.

In order to minimise the wear in the surface sections 29, 30, in which relative movement between the angle guide plate 4 and the tension clamp 6 occurs during assembly and operation, the surface section 29 for example, on which the individual end section 22 of the spring arms 23 of the tension clamp 6 moves in the area of the mounting spaces 21*a*, 21*b*, is covered with a wear-resistant material 31. In exactly the same manner, wear-resistant material 32 can be applied in the area of the surface section 30 on which the W-shaped tension clamp 6 slides into the groove 28 during its assembly, with its return bend present in each case between its middle loop and its spring arms 23. The wear-resistant material 31, 32 can in this case be connected to the angle guide plate 4 in a material bond by spraying or by another suitable application process, in such a way that it holds sufficiently strongly to the angle guide plate 4 even under the hard conditions which prevail in actual practice.

For pre-assembly of the system 1, the angle guide plate 4 is placed on the support surface 10 of the concrete sleeper 3 in such a way that a projection 4*a* formed in an inherently known manner on the underside of the angle guide plate 4 engages in positive fit into the groove 10*a* of the concrete sleeper 3 and the angle guide plate is supported on the support shoulder 9 of the concrete sleeper 3 with its side located opposite the contact surface 14. The angle guide plate 4 is now aligned in such a way that the passage aperture 13 of the angle guide plate 4 is aligned flush to the dowel located in the sleeper 3, not visible here.

The tension clamp 6 formed in a W-shape is then put onto the angle guide plate 4 in such a way that it lies with its spring arms 23 with their free end sections 22 in each case in one of the mounting spaces 21*a*, 21*b* formed in the ramp 20 of the rib 15. By screwing the tension screw 7 into the dowel, not shown, the tension clamp 6 is then clamped until the tension clamp 6 is sufficiently tensioned to be held in the pre-assembly position.

In a corresponding manner, a second system, likewise not shown here, constructed in an identical manner to the system 1, is pre-assembled on the side of the mounting 8 opposite to the support shoulder 9. The rail is then placed into the space delimited laterally by the contact surfaces 14 of these two systems. In this situation, as shown in the Figures for the system 1, its rail foot 2 is then in contact laterally with the contact surfaces 14 of the angle guide plate 4 of the respective system 1.

For finished assembly of the system 1, the tension clamp 6, with the tension screw 7 unchanged and tightened, is pushed with the aid of an automatically operating assembly device, not shown here, in a straight line movement L in the direction of the rail foot 2. The resilient elastic arms 23 of the tension clamp 6 slide in this situation, under slight additional tension, with their end sections 22 in each case under slight additional resistance out of the individual mounting space 21*a*, 21*b* over the adjacent section 24 of the ramp 20 until they have reached the rounded cup 18 of the rib 15.

The end sections 22 then slide over the slide surface 19 adjacent to the cup 18 and from there onto the rail foot 2. This movement is continued until the tension clamp 6 sits with its support sections 27 connecting with the middle loop 26 of the tension clamp 6 in a groove 29 extending along the section 28 of the angle guide plate 4 in contact at the support shoulder 9.

Due to the special shape of the transition of the mounting space 21*a*, 21*b* to the cup 18 of the rib 15, and the rounding of the cup 18 itself, the displacement of the tension clamp 6 out of the pre-assembly position (FIG. 3) into the finished final assembly position can be carried out essentially free of any abrupt force changes in one movement sequence. The tensioning of the tension clamp 6 by the tension screw 7 does not need to be released for this purpose, because the spring resilience of the spring arms 22 of the tension clamp is sufficient for the movements required to be carried out during the displacement to pass over the cup 18 of the rib 15.

Figure 5:
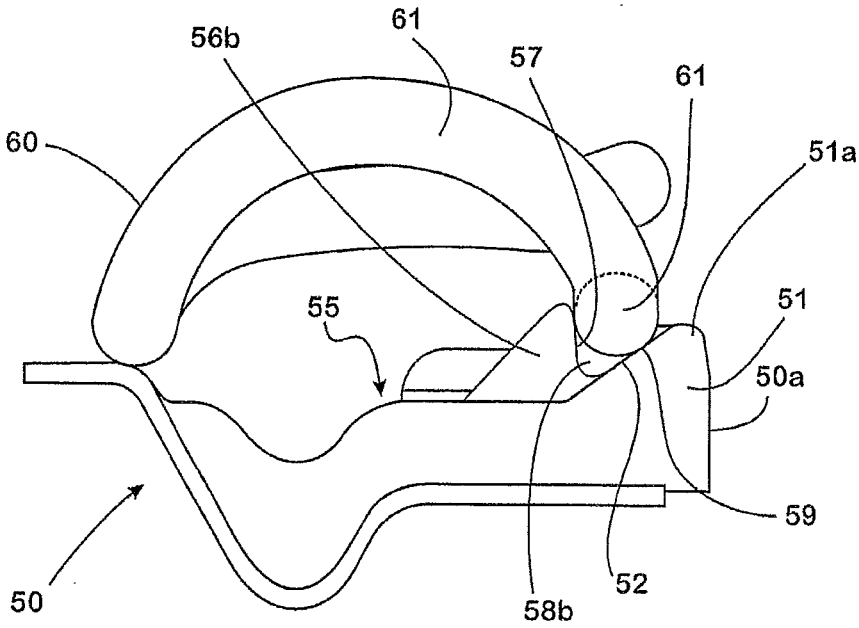
FIG. 5 An alternative embodiment of a system for securing a rail, in the pre-assembly position in a side view corresponding to FIG. 3.

Shown in FIG. 5 is a variant of the system described heretofore for the securing of a rail, not shown here. This system also comprises an angle guide plate 50, the basic shape of which corresponds to the basic shape of the angle guide plate 4. Accordingly, the angle guide plate 50, as can be seen from FIGS. 5 and 6, has a contact surface 50*a*, corresponding to the contact surface 14 of the angle guide plate 4, facing the rail foot, not shown, of the rail which is to be mounted, a rib 51 corresponding to the rib 15 of the angle guide plate 4 adjacent to the contact surface 51*a*, with a ramp 52 corresponding to the ramp 20 of the angle guide plate 4, and a passage aperture 53 formed in the angle guide plate 50, corresponding to the passage aperture 13 of the angle guide plate 4, as well as a middle table-shaped section 54, corresponding to the section 16 of the angle guide plate 4, on which a shaped element is formed which guides the tension clamp 60 to be mounted on the angle guide plate 50 in its finished assembled position.

As a departure from the angle guide plate 4, however, with the angle guide plate 50 the ramp 52 of the rib 51 has two flat ramp surfaces 52*a*', 52*a*", one of which in each case is arranged between one of the narrow sides 50*b*', 50*b*" and the middle section 54 of the angle guide plate 50. The ramp surfaces 52*a*', 52*a*" in this situation extend obliquely in the direction of the cup 51*a* of the rib 51, in a side view seen from the foot of the ramp 52.

In addition, on the upper side 55 of the angle guide plate 50 there is formed in each case to the side of the middle section 54 and immediately adjacent to this, offset in the direction of one of the narrow sides of the angle guide plate 50, in each case an elevation 56*a*, 56*b* projecting upwards in the form of a hump. The elevations 56*a*, 56*b* have in each case on their side facing the ramp 52 a contact surface 57 running essentially parallel to the contact surface 51, which at its lower end, facing the foot of the ramp 52, merges without abrupt change into the ramp surface 52*a*', 52*a*" allocated in each case, in the manner of a valley-shaped recess. The contact surfaces 57, seen in a side view, in each case define an angle which is less than 90° with the ramp surface 52*a*', 52*a*" facing them in each case.

In this way, a recess 58*a*, 58*b* is present in each case between the contact surface 57 and the ramp surface 52*a*', 52*a*" facing it in each case, this recess 58*a*, 58*b* being formed as a seat for the respective free end section 61 in each case of one of the spring arms 62 of the tension clamp 6 to be pre-assembled on the angle guide plate 50.

The contact surfaces 57 of the elevations 56*a*, 56*b* and the ramp surfaces 52*a*', 52*a*" facing them are in this situation arranged at an acute angle to one another, such that the recesses 58*a*, 58*b*, when the tension clamp 60 is pre-assembled, surround the respective end section 61 by less than half of its circumference. The transition 59 between the recesses 58*a* 58*b* and the section 52*b* of the flat ramp surfaces 52*a*', 52*a*" of the angle guide plate 50 following on in each case from the recess 58 in the direction of the rail which is to be mounted is formed without any abrupt change.

In the pre-assembly position, the end sections 61 of the tension clamp 6 sit in the recess 58*a*, 58*b* facing them in each case. To pre-tension the tension clamp 60, a light pressure force is exerted on the loop of the tension clamp 60 by means of a screw, not shown here such that the tension clamp 60 can no longer move of its own accord out of the pre-assembly position. This guarantees the support of the free end sections 61 of the tension clamp 60 at the elevations 56*a*, 56*b* and that the tension clamp 60 does not twist during the tensioning but is held securely in its pre-assembly position. During final assembly, the end sections 61 of the tension clamp 60 can then slide unhindered on the individual flat ramp surface 52*a*', 52*a*" without any abrupt change, until, in the manner already described for the angle guide plate 4, they rest on the rail foot, not shown. The height H of the rib 51 can in this situation be dimensioned in such a way that even thicker rail feet or rail feet standing higher due to appropriate underlays can always be reliably obtained.

REFERENCE FIGURES

FIGS. 1-4

1 System for securing a rail
2 Rail foot
3 Concrete sleeper
4 Angle guide plate
4*a* Projection formed on the underside of the angle guide plate 4
5 Elastic layer
6 Tension clamp
7 Tension screw
8 Recess
9 Support shoulder
10 Support surface
10*a* Groove in concrete sleeper 3
11 Upper side of the angle guide plate 4
12 Shaped elements
13 Passage aperture
14 Contact surface
15 Rib
16 Middle section of the rib 15
17*a*,17*b* Side section of the rib 15
18 Cup
19 Sliding surface
20 Ramp
21*a*,21*b* Mounting spaces
22 End sections of the spring arms 23 of the tension clamp 6
23 Spring arms of the tension clamp 6
24,25 Sections of the ramp 20 adjacent to the recess 21*a*, 21*b*
25 Middle loop of the tension clamp 6
26 Support sections of the tension clamp 6
27 Section of the angle guide plate 4 in contact on the support shoulder 9
28 Groove
U Solid foundation (concrete sleeper 3)

Figure 6:
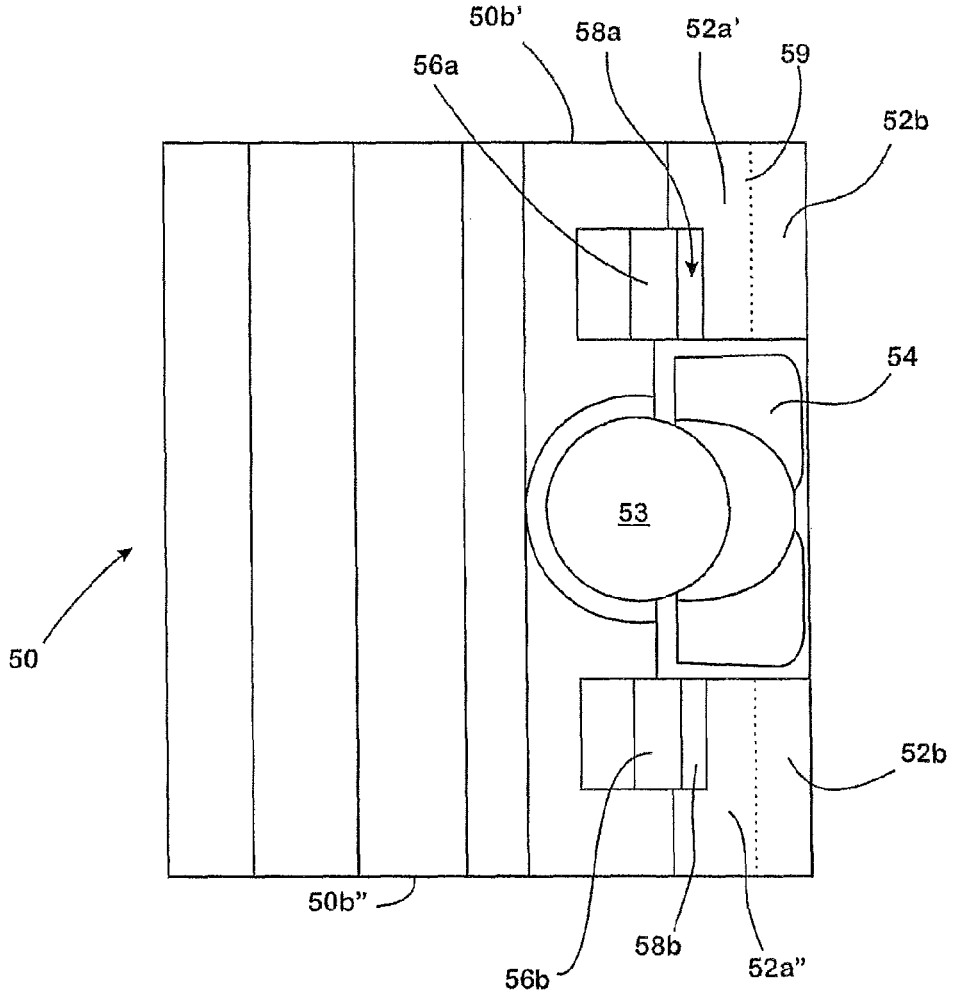
FIG. 6 An angle guide plate used in the system according to FIG. 5, in plan view.

FIGS. 5 and 6

50 Angle guide plate
50*a* Contact surface of the angle guide plate 50

50*b*',50*b*" Narrow sides of the angle guide plate 50
51 Rib of the angle guide plate 50
51*a* Cup of the rib 51
52 Ramp of the angle guide plate 50
52*a*',52*a*" Ramp surfaces of the angle guide plate 50
52*b* Respective section of the ramp surfaces 52*a*', 52*a*" adjacent to the cup 51*a* of the rib 51
53 Passage aperture of the angle guide plate 50
54 Middle section of the angle guide plate 50
55 Upper side of the angle guide plate 50
56*a*,56*b* Elevations
57 Contact surface of the elevations 56*a*, 56*b*
58*a*,58*b* Recesses
59 Transition between the recesses 58*a*, 58*b* and the section 52*b* of the ramp surfaces 52*a*', 52*a"*
60 Tension clamp
61 Free end sections of the tension clamp 60
62 Spring arms of the tension clamp 60
H Height of the rib 51

The invention claimed is:

1. An angle guide plate for fitting a rail on a foundation, comprising a recess serving as a seat for a free end section of a spring arm of a tension clamp to be mounted on the angle guide plate, wherein said tension clamp is located in a pre-assembly position, wherein the recess surrounds the end section by less than half of its circumference, and wherein the transition between the recess and the section of the angle guide plate which follows on from the recess in the direction of the rail which is to be fitted is formed such as to be free of any abrupt change.

2. The angle guide plate according to claim 1, wherein the angle guide plate has a rib which extends along a contact surface, with which the angle guide plate in a finished mounted state is in contact on the rail, and in that the recess is formed into the rib.

3. The angle guide plate according to claim 2, wherein on the side of the rib facing away from the contact surface a ramp is formed leading from a surface of a main section of the angle guide plate carrying the rib, obliquely to a cup of the rib, into which the ramp mounting space is formed.

4. The angle guide plate according to claim 3, wherein a transition between the mounting space and an adjacent section of the ramp is rounded.

5. The angle guide plate according to claim 3, wherein the mounting space delimits the cup of the rib and the transition from the mounting space to the cup is designed to be free of any abrupt change.

6. The angle guide plate according to claim 5, wherein the cup has a rounded cross-section form.

7. The angle guide plate according to claim 3, wherein on a front side of the rib, allocated to the rail which is to be mounted, a sliding surface for the end section of the tension clamp is formed, leading obliquely from the cup of the rib as far as the contact surface.

8. The angle guide plate according to claim 1, wherein in an area of at least one of its surface sections coming in contact with the tension clamp to be mounted on it, the angle guide plate has a wear-resistant material.

9. The angle guide plate according to claim 8, wherein the wear-resistant material is applied onto the individual surface section.

10. The angle guide plate according to claim 1, wherein at least one contact surface is formed on an upper side of the angle guide plate on which the free end section of the spring arm of the tension clamp is supported.

11. The angle guide plate according to claim 10, wherein the contact surface is formed at an elevation projecting in a hump shape from the upper side of the angle guide plate.

12. A system for securing a rail on a foundation, comprising an angle guide plate, a tension clamp arranged on the angle guide plate having at least one spring arm taking effect with its free end section on the rail which is to be secured such that the free end section of the tension clamp is movable between a pre-assembly position where the tension clamp engages the angle guide plate and an assembly position where the tension clamp engages the rail, and a tensioning means for tensioning the tension clamp against the foundation.

13. The system according to claim 12, wherein the foundation is formed by a concrete sleeper or a concrete plate.

14. The system according to claim 12, wherein a shoulder is formed at the foundation, and the angle guide plate is supported on said shoulder.

* * * * *

UNITED STATES PATENT AND TRADEMARK OFFICE

CERTIFICATE OF CORRECTION

PATENT NO. : 8,668,152 B2
APPLICATION NO. : 12/996902
DATED : March 11, 2014
INVENTOR(S) : Bösterling et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 217 days.

Signed and Sealed this
Twenty-ninth Day of September, 2015

Michelle K. Lee

Michelle K. Lee
*Director of the United States Patent and Trademark Office*